US008948663B2

(12) United States Patent
Tomishi et al.

(10) Patent No.: US 8,948,663 B2
(45) Date of Patent: Feb. 3, 2015

(54) DEVELOPING DEVICE AND IMAGE-FORMING APPARATUS

(71) Applicant: Fuji Xerox Co., Ltd., Minato-ku, Tokyo (JP)

(72) Inventors: Ryota Tomishi, Kanagawa (JP); Yoshitaka Nakajima, Kanagawa (JP); Shigeru Inaba, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 149 days.

(21) Appl. No.: 13/625,516

(22) Filed: Sep. 24, 2012

(65) Prior Publication Data

US 2013/0230341 A1 Sep. 5, 2013

(30) Foreign Application Priority Data

Mar. 5, 2012 (JP) ..... 2012-048518

(51) Int. Cl.
*G03G 15/08* (2006.01)
*G03G 15/09* (2006.01)

(52) U.S. Cl.
CPC ..... *G03G 15/09* (2013.01); *G03G 15/0808* (2013.01)
USPC ..... 399/272

(58) Field of Classification Search
CPC ..... G03G 15/09
USPC ..... 399/272
See application file for complete search history.

(56) References Cited

U.S. PATENT DOCUMENTS 5,212,525 A * 5/1993 Noami et al. ..... 399/276
5,525,752 A * 6/1996 Izumizaki et al. ..... 399/275
5,987,288 A * 11/1999 Mori et al. ..... 399/269
7,356,288 B2 * 4/2008 Iwata et al. ..... 399/254
7,620,351 B2 * 11/2009 Onda et al. ..... 399/274
8,509,655 B2 * 8/2013 Imanaka et al. ..... 399/176
8,515,319 B2 * 8/2013 Takemoto ..... 399/273
8,615,187 B2 * 12/2013 Kunihiro ..... 399/273
2001/0019675 A1 * 9/2001 Masuda et al. ..... 399/277
2005/0111882 A1 * 5/2005 Sudo et al. ..... 399/222
2007/0127952 A1 * 6/2007 Terashima et al. ..... 399/277
2009/0226220 A1 * 9/2009 Kunihiro et al. ..... 399/273

(Continued)

FOREIGN PATENT DOCUMENTS

JP 11-007194 * 1/1999 ..... G03G 15/08
JP 11-7194 A 1/1999

(Continued)

*Primary Examiner* — Clayton E Laballe
*Assistant Examiner* — Kevin Butler
(74) *Attorney, Agent, or Firm* — Sughrue Mion, PLLC

(57) ABSTRACT

A developing device includes a developer-carrying member and a developer control member, a supply member, and a rotating member that are disposed opposite the developer-carrying member. The developer-carrying member accommodates a magnetic source that generates a magnetic force for carrying a developer containing magnetic particles on an outer surface thereof. The developer control member controls the thickness of a layer of the developer carried on the outer surface of the developer-carrying member. The supply member rotates to transport the developer in a rotation axis direction thereof and to supply the developer to the developer-carrying member. The rotating member is disposed at a position where the rotating member is submerged in the developer between the developer control member and the supply member and rotates to supply the developer from between the developer control member and the supply member to the supply member.

13 Claims, 9 Drawing Sheets

(56) References Cited

U.S. PATENT DOCUMENTS

2012/0027470 A1* 2/2012 Kunihiro ..... 399/273
2012/0051798 A1* 3/2012 Kunihiro ..... 399/274

FOREIGN PATENT DOCUMENTS

JP 2002-174951 * 6/2002 ..... G03G 15/08
JP 2002-174951 A 6/2002

* cited by examiner

FIG. 9

| A/B | VARIATION IN AMOUNT OF DEVELOPER TRANSPORTED BY DEVELOPING SLEEVE IN AXIAL DIRECTION | CHANGE IN AMOUNT OF DEVELOPER TRANSPORTED OVER TIME |
|---|---|---|
| 0.20 | C | A |
| 0.25 | A | A |
| 0.30 | A | A |
| 0.50 | A | A |
| 0.65 | B | A |
| 0.80 | B | A |

DEVELOPING DEVICE AND IMAGE-FORMING APPARATUS

CROSS-REFERENCE TO RELATED APPLICATIONS

This application is based on and claims priority under 35 USC 119 from Japanese Patent Application No. 2012-048518 filed Mar. 5, 2012.

BACKGROUND

Technical Field

The present invention relates to developing devices and image-forming apparatuses.

SUMMARY

According to an aspect of the invention, there is provided a developing device including a developer-carrying member that is substantially tubular, that accommodates a magnetic source that generates a magnetic force for carrying a developer containing magnetic particles on an outer surface thereof, and that rotates in a circumferential direction thereof; a developer control member that is disposed opposite the developer-carrying member and that controls the thickness of a layer of the developer carried on the outer surface of the developer-carrying member; a supply member that is disposed opposite the developer-carrying member upstream of the developer control member in a rotational direction of the developer-carrying member and that rotates to transport the developer in a rotation axis direction thereof and to supply the developer to the developer-carrying member; and a rotating member that is rotatably disposed opposite the developer-carrying member at a position where the rotating member is submerged in the developer between the developer control member and the supply member and that rotates to supply the developer from between the developer control member and the supply member to the supply member.

BRIEF DESCRIPTION OF THE DRAWINGS

Exemplary embodiments of the present invention will be described in detail based on the following figures, wherein:

FIG. 9 is a table showing evaluations of the image-forming apparatus according to the exemplary embodiment of the present invention for the variation in the amount of developer transported by a developing sleeve in the axial direction and the change in the amount of developer transported over time with varying positions of the rotating member.

DETAILED DESCRIPTION

A developing device and an image-forming apparatus according to an exemplary embodiment of the present invention will now be described.

Overall Structure

Figure 1:
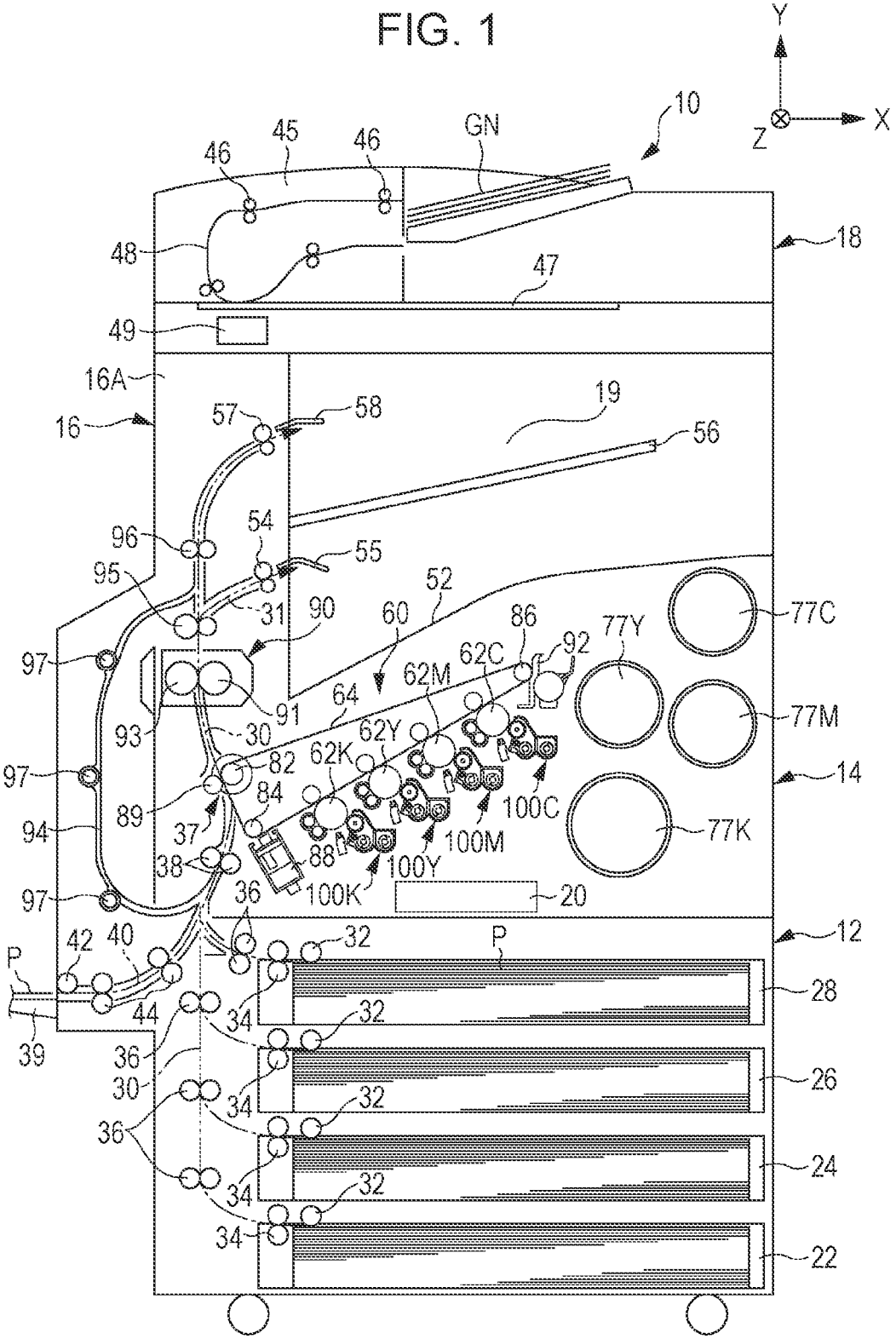
FIG. 1 is a schematic view of the overall structure of an image-forming apparatus according to an exemplary embodiment of the present invention.

FIG. 1 illustrates an image-forming apparatus 10 according to an exemplary embodiment. The image-forming apparatus 10 includes, in order from the bottom to the top thereof in the vertical direction (the direction indicated by the arrow Y in the figure), a paper container section 12 and an image-forming section 14. The paper container section 12 contains recording paper P, which is an example of a recording medium. The image-forming section 14 is disposed above the paper container section 12 and forms an image on the recording paper P fed from the paper container section 12. The image-forming apparatus 10 also includes an eject section 16, a document-reading section 18, and a controller 20. The eject section 16 is integrally provided with the image-forming section 14 to the upper left thereof and ejects the recording paper P having the image formed thereon. The document-reading section 18 is disposed above the eject section 16 and reads a document GN. The controller 20 is disposed in the image-forming section 14 and controls the operations of the individual sections of the image-forming apparatus 10. In the description below, the vertical direction is referred to as "Y direction," the horizontal direction is referred to as "X direction," and the depth direction, which is perpendicular to the X direction and the Y direction, is referred to as "Z direction."

The paper container section 12 includes a first container 22, a second container 24, a third container 26, and a fourth container 28. The containers 22, 24, 26, and 28 contain recording paper P of different sizes and are arranged in parallel in the Y direction. The containers 22, 24, 26, and 28 have feed rollers 32 that feed the recording paper P therefrom to a transport path 30 provided in the image-forming apparatus 10. Pairs of transport rollers 34 and pairs of transport rollers 36 are disposed downstream of the feed rollers 32 along the transport path 30 in the image-forming apparatus 10. The transport rollers 34 and 36 transport the recording paper P sheet by sheet. A pair of registration rollers 38 are disposed in the image-forming section 14 downstream of the transport rollers 36 along the transport path 30 in the transport direction of the recording paper P. The registration rollers 38 stop the recording paper P and then feed it to a second transfer section 37 (described in detail later) at a predetermined timing.

The image-forming section 14 and the eject section 16 include a housing 16A forming the body of the image-forming apparatus 10. The portion of the housing 16A to the upper left of the image-forming section 14 protrudes upwardly of the portion to the upper center and upper right of the image-forming section 14 as viewed in the Z direction. The upper end of the housing 16A is joined to the lower end of the document-reading section 18. The top surface of the image-forming section 14, the bottom surface of the document-reading section 18, and the right surface of the eject section 16 form an eject region 19 in the image-forming apparatus 10. The recording paper P is ejected from the eject section 16 to the eject region 19 and is stacked therein.

An auxiliary transport path 40 is provided across the transport path 30 from the transport rollers 36 of the fourth container 28. The recording paper P is transported along the auxiliary transport path 40 from a collapsible manual feed section 39 to the transport path 30. The manual feed section 39 is provided on the left surface of the image-forming apparatus 10 as viewed in the Z direction. The auxiliary transport path 40 includes a feed roller 42 and transport rollers 44. The feed roller 42 feeds the recording paper P from the manual feed section 39 to the auxiliary transport path 40. The transport rollers 44 are disposed downstream of the feed roller 42 and transport the recording paper P sheet by sheet. The downstream end of the auxiliary transport path 40 is connected to the transport path 30.

A fixing device 90 is disposed in the image-forming section 14 downstream of the second transfer section 37 along the transport path 30. The fixing device 90 melts and presses developer (toner) on the recording paper P to fix it to the recording paper P.

The fixing device 90 includes a fixing roller 91 and a pressing roller 93. The fixing roller 91 is disposed on the toner image side of the recording paper P and accommodates a heat source such as a halogen heater (not shown). The pressing roller 93 presses the recording paper P against the fixing roller 91. As the recording paper P is advanced through the contact area (nip) between the fixing device 90 and the pressing roller 93 in the fixing device 90, the recording paper P is heated and pressed to fix the toner image thereto.

Figure 2:
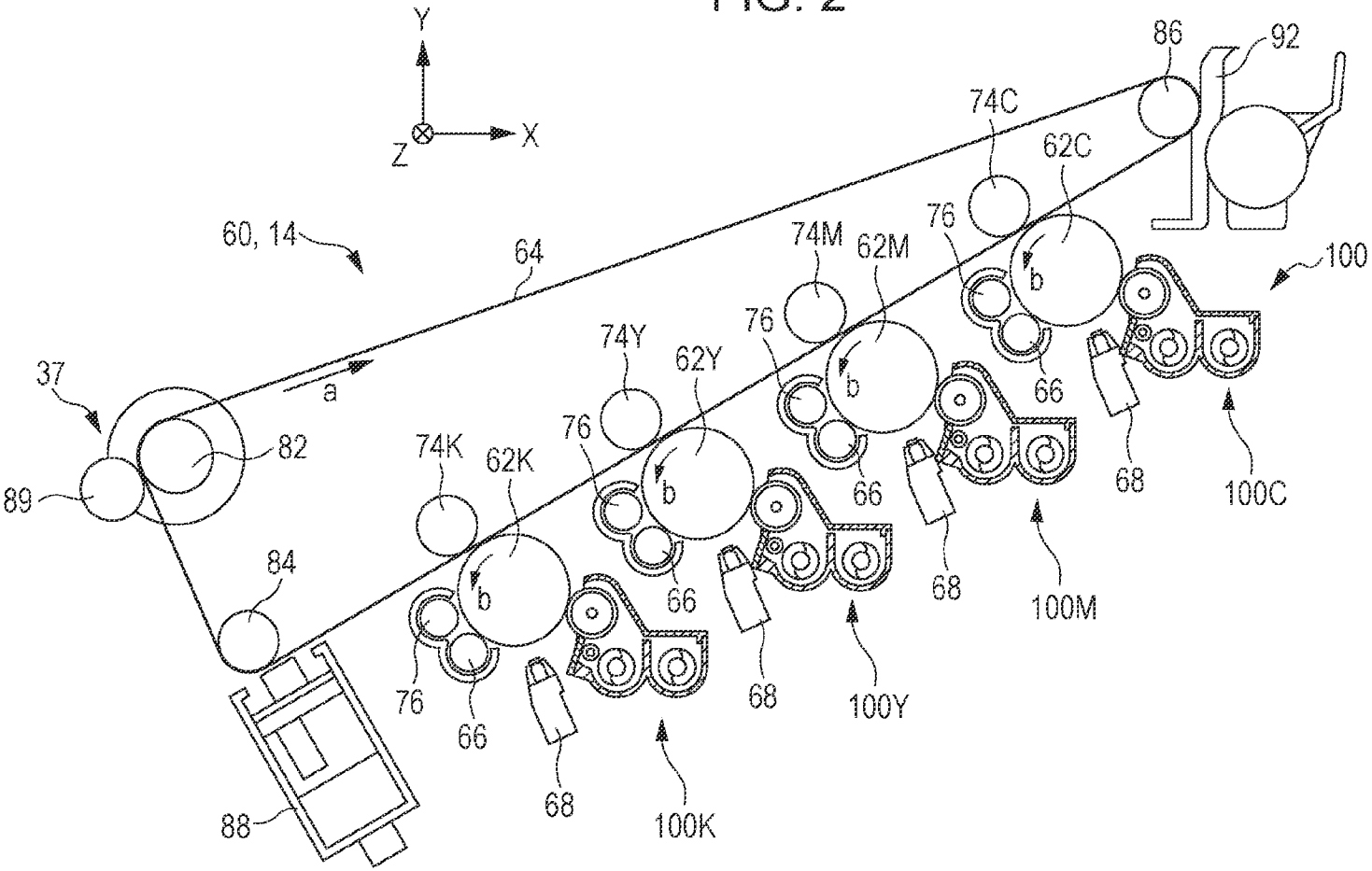
FIG. 2 is a schematic view of an image-forming unit according to the exemplary embodiment of the present invention.

As illustrated in FIGS. 1 and 2, the image-forming section 14 includes an image-forming unit 60 disposed in the center thereof. The image-forming unit 60 forms a toner image (developer image) on the recording paper P using black (K), yellow (Y), magenta (M), and cyan (C) toners.

The image-forming unit 60 includes photoreceptors 62K, 62Y, 62M, and 62C, which are examples of image-carrying members that carry latent images on the outer surfaces thereof. The photoreceptors 62K, 62Y, 62M, and 62C correspond to black (K), yellow (Y), magenta (M), and cyan (C) toners, respectively. The description below uses reference numerals followed by the alphabets K, Y, M, and C if the corresponding elements need to be distinguished, and omits the alphabets K, Y, M, and C if the corresponding elements do not need to be distinguished because they are similar.

As illustrated in FIG. 2, the photoreceptors 62K, 62Y, 62M, and 62C are arranged, in the above order, in the direction toward the upper right of the figure. The photoreceptors 62K, 62Y, 62M, and 62C rotate in the direction indicated by the arrow b (counterclockwise in the figure) and carry electrostatic latent images formed on the outer surfaces thereof by light irradiation. Each photoreceptor 62 is surrounded by, in order in the direction indicated by the arrow b, a charging roller 66, a light-emitting diode (LED) head 68, a developing device 100, an intermediate transfer belt 64 (first transfer roller 74), and a cleaning roller 76. The developing device 100 develops a latent image on the photoreceptor 62 with a developer to form a developer image, as described in detail later.

The charging roller 66 includes, for example, a stainless steel core and multiple layers (not shown) formed therearound, including a conductive elastic layer, an intermediate layer, and a surface resin layer. The core of the charging roller 66 is configured to be rotatable such that the charging roller 66 is rotated in contact with the surface layer of the photoreceptor 62 as it is rotated. As a voltage is applied to the charging roller 66 by a voltage-applying unit (not shown), electrical discharge occurs, thus charging the outer surface of the photoreceptor 62.

The LED head 68 irradiates (exposes) the outer surface of the photoreceptor 62 charged by the charging roller 66 with light corresponding to the particular toner color to form an electrostatic latent image. Alternatively, the four photoreceptors 62K, 62Y, 62M, and 62C may be exposed using a single polygon mirror that scans a laser beam thereacross.

The intermediate transfer belt 64 is an endless belt entrained about and supported by a belt transport roller 82, an auxiliary roller 84, and a drive roller 86 so as to be rotatable in the direction indicated by the arrow a (clockwise in the figure) . The belt transport roller 82 is disposed in the second transfer section 37. The auxiliary roller 84 is disposed to the lower right of the belt transport roller 82. The drive roller 86 is disposed to the upper right of the belt transport roller 82 and is driven by a motor (not shown). The outer surface of the intermediate transfer belt 64 is a transfer surface to which toner images are transferred. The outer surfaces of the photoreceptors 62K, 62Y, 62M, and 62C contact the transfer surface of the intermediate transfer belt 64 between the drive roller 86 and the auxiliary roller 84.

The first transfer rollers 74 (74K, 74Y, 74M, 74C) are disposed across the intermediate transfer belt 64 from the photoreceptors 62K, 62Y, 62M, and 62C, respectively. The first transfer rollers 74 contact the inner surface of the intermediate transfer belt 64. As a voltage is applied to the first transfer rollers 74 by a voltage-applying unit (not shown), the potential difference between the first transfer rollers 74 and the photoreceptors 62, which are grounded, causes toner images to be transferred from the photoreceptors 62 to the transfer surface of the intermediate transfer belt 64. The toner images are transferred to and superimposed on the intermediate transfer belt 64 before the intermediate transfer belt 64 completes one revolution.

A toner density sensor 88 is disposed across the intermediate transfer belt 64 from the auxiliary roller 84. The toner density sensor 88 functions to detect the density of the toner image transferred to the transfer surface of the intermediate transfer belt 64. A cleaning member 92 is disposed across the intermediate transfer belt 64 from the drive roller 86. The cleaning member 92 removes residual toner from the transfer surface of the intermediate transfer belt 64 after second transfer.

The second transfer section 37 includes the belt transport roller 82, about which the intermediate transfer belt 64 is entrained, and a second transfer roller 89 disposed across the intermediate transfer belt 64 from the belt transport roller 82. As a voltage is applied to the belt transport roller 82 or the second transfer roller 89 by a voltage-applying unit (not shown), the potential difference between the belt transport roller 82 and the second transfer roller 89 causes the toner image to be transferred from the intermediate transfer belt 64 to the recording paper P. The intermediate transfer belt 64, the first transfer rollers 74, the belt transport roller 82, and the second transfer roller 89 are examples of transfer units.

As illustrated in FIG. 1, replaceable toner cartridges 77K, 77Y, 77M, and 77C containing black (K), yellow (Y), magenta (M), and cyan (C) toners, respectively, are disposed to the right of the cleaning member 92 in the image-forming section 14. A double-sided transport path 94 is provided to the left of the transport path 30 in the image-forming section 14. The recording paper P is transported and inverted along the double-sided transport path 94 to form images on both surfaces of the recording paper P.

The double-sided transport path 94 has one end thereof connected to the transport path 30 between transport rollers 95 and transport rollers 96 and has the other end thereof connected to the transport path 30 upstream of the registration rollers 38. The transport rollers 95 are disposed downstream of the fixing device 90 in the transport direction of the recording paper P. The transport rollers 96 are disposed downstream of the transport roller 95 and are configured for switching between opposite rotational directions. The double-sided transport path 94 also includes transport rollers 97 that transport the recording paper P fed by the transport roller 96 toward the registration rollers 38. During double-sided image formation, recording paper P having a toner image fixed to the front surface thereof by the fixing device 90 is advanced into the double-sided transport path 94 by reverse rotation of the transport rollers 96 and operation of a path-switching member (not shown). The recording paper P is then advanced between the registration rollers 38 again. Thus, the recording paper P is inverted.

Lower eject rollers 54 are disposed on a transport path 31 branched off in the eject section 16 from the transport path 30 downstream of the transport rollers 95 toward the exit region 19. The lower eject rollers 54 eject the recording paper P to a lower stage 52 disposed above the image-forming section 14. A lower detector 55 is disposed adjacent to the lower eject rollers 54 to detect the height of the recording paper P stacked on the lower stage 52. Upper eject rollers 57 are disposed in the eject section 16 on the transport path 30 downstream of the transport rollers 96. The upper eject rollers 57 eject the recording paper P to an upper stage 56 disposed above the lower stage 52. An upper detector 58 is disposed adjacent to the upper eject rollers 57 to detect the height of the recording paper P stacked on the upper stage 56.

The document-reading section 18 includes a document transport device 45, a platen glass 47, and a document-reading device 49. The document transport device 45 automatically transports the document GN to be read sheet by sheet. The platen glass 47 is disposed below the document transport device 45, and the document GN is placed thereon. The document-reading device 49 reads the document GN transported by the document transport device 45 or placed on the platen glass 47. The document transport device 45 has an automatic transport path 48 along which pairs of transport rollers 46 are arranged. A portion of the automatic transport path 48 is located such that the recording paper P passes over the platen glass 47. The document-reading device 49 reads the document GN transported by the document transport device 45 while remaining stationary at the left end of the platen glass 47 or moving across the document GN placed on the platen glass 47 in the X direction.

An image-forming process of the image-forming apparatus 10 will now be described.

As illustrated in FIG. 1, upon startup of the image-forming apparatus 10, image data for black (K), yellow (Y), magenta (M), and cyan (C) is fed to the LED heads 68 (see FIG. 2) externally or from an image processor (not shown). The LED heads 68 then emit light based on the image data to expose the outer surfaces of the photoreceptors 62 charged by the charging rollers 66. As a result, electrostatic latent images corresponding to the image data for the respective colors are formed on the surfaces of the photoreceptors 62. The electrostatic latent images formed on the surfaces of the photoreceptors 62 are developed as toner images by the developing devices 100K, 100Y, 100M, and 100C. The toner images are sequentially transferred from the surfaces of the photoreceptors 62 to the intermediate transfer belt 64 by the first transfer rollers 74 (see FIG. 2).

The recording paper P fed from the paper container section 12 and transported along the transport path 30 is transported to the second transfer section 37 by the registration rollers 38 in synchronism with the multiple transfer of the toner images to the intermediate transfer belt 64. The toner image formed by the multiple transfer is transferred from the intermediate transfer belt 64 to the recording paper P transported to the second transfer section 37 by the second transfer roller 89.

The recording paper P having the toner image transferred thereto is transported to the fixing device 90. In the fixing device 90, the fixing roller 91 and the pressing roller 93 heat and press the toner image to fix it to the recording paper P. The recording paper P having the toner image fixed thereto is ejected from the eject section 16 to the lower stage 52 or the upper stage 56. To form images on both sides of the recording paper P, after the fixing device 90 fixes an image to the front surface of the recording paper P, the lower end of the recording paper P is transported from the transport roller 96 to the double-sided transport path 94 and then to the registration rollers 38 (transport path 30) to interchange the leading end with the trailing end of the recording paper P. An image is then formed on the back surface of the recording paper P and is fixed thereto.

Relevant Structure

The developing devices 100 will now be described.

The developing devices 100K, 100Y, 100M, and 100C illustrated in FIG. 2 are similar to each other except for the toner contained in the developer used; therefore, they will be collectively described as "developing devices 100" without distinguishing therebetween.

Figure 3A:
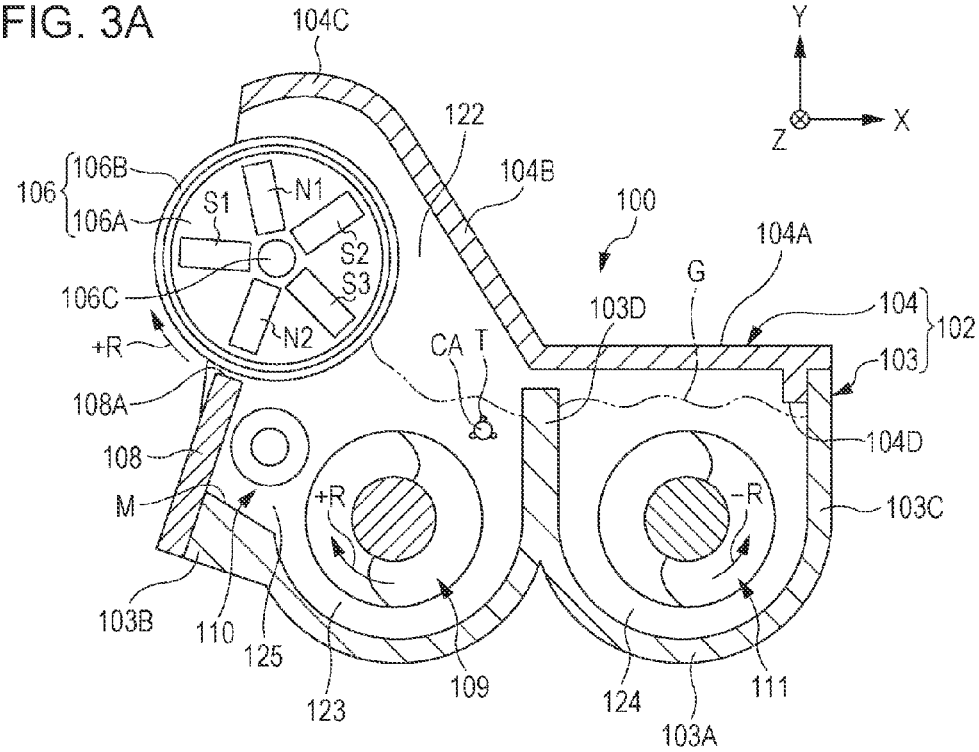
FIG. 3A is a cross-sectional view of a developing device according to the exemplary embodiment of the present invention.

As illustrated in FIG. 3A, each developing device 100 includes a housing 102, a developing roller 106, a trimmer 108, a first auger 109, a second auger 111, and a rotating member 110. The housing 102 contains a developer G. The trimmer 108, which is an example of a developer control member, controls the thickness of a layer of the developer G carried on the outer surface of the developing roller 106. The first auger 109, which is an example of a supply member, supplies the developer G to the developing roller 106. The second auger 111 circulates the developer G together with the first auger 109. The rotating member 110 rotates to supply the developer G to the first auger 109.

For example, the developer G is a two-component developer containing a toner T, which is an example of negatively charged particles, and a magnetic carrier CA, which is an example of positively charged magnetic particles. The developer G fills the housing 102 to such a height as to cover (submerge) the entire rotating member 110, described in detail later.

The housing 102 includes a container body 103 and a cover 104 covering the top of the container body 103. The housing 102 has a developing roller chamber 122, a first stirring chamber 123, a second stirring chamber 124, and a developer return chamber 125. The developing roller chamber 122 contains the developing roller 106. The first stirring chamber 123 is provided below the developing roller chamber 122. The second stirring chamber 124 is adjacent to the first stirring chamber 123. The developer return chamber 125, described later, is adjacent to the side of the first stirring chamber 123 facing away from the second stirring chamber 124.

The container body 103 includes a bottom wall 103A, an extending portion 103B, a sidewall 103C, and a partition wall 103D as viewed in the Z direction. The bottom wall 103A is curved at two positions in the X direction so as to protrude downward in a convex shape. The extending portion 103B is disposed at the left end of the bottom wall 103A. The sidewall 103C is disposed upright at the right end of the bottom wall 103A. The partition wall 103D is disposed upright at the center of the bottom wall 103A and separates the first stirring chamber 123 from the second stirring chamber 124. The extending portion 103B has a top surface M inclined downward from the trimmer 103 toward the first auger 109.

The cover 104 includes a top wall 104A, an inclined wall 104B, a curved wall 104C, and a fitting portion 104D. The top wall 104A is disposed above the second stirring chamber 124. The inclined wall 104B extends from the left end of the top wall 104A to the upper left so as to cover the developing roller chamber 122. The curved wall 104C is continuous with the top end of the inclined wall 104B. The fitting portion 104D extends downward from an end of the top wall 104A and is fitted to the container body 103.

Figure 3B:
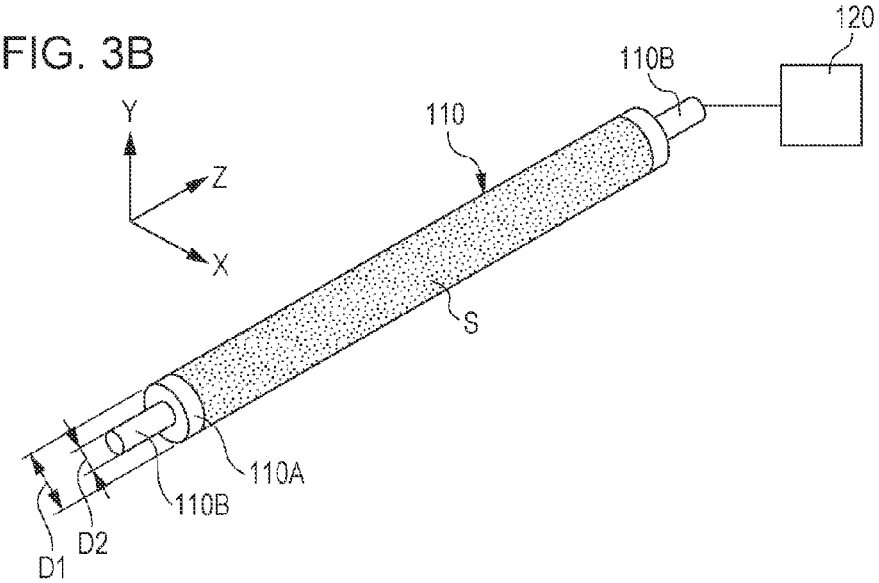
FIG. 3B is a schematic view of a rotating member according to the exemplary embodiment of the present invention.
Figure 4:
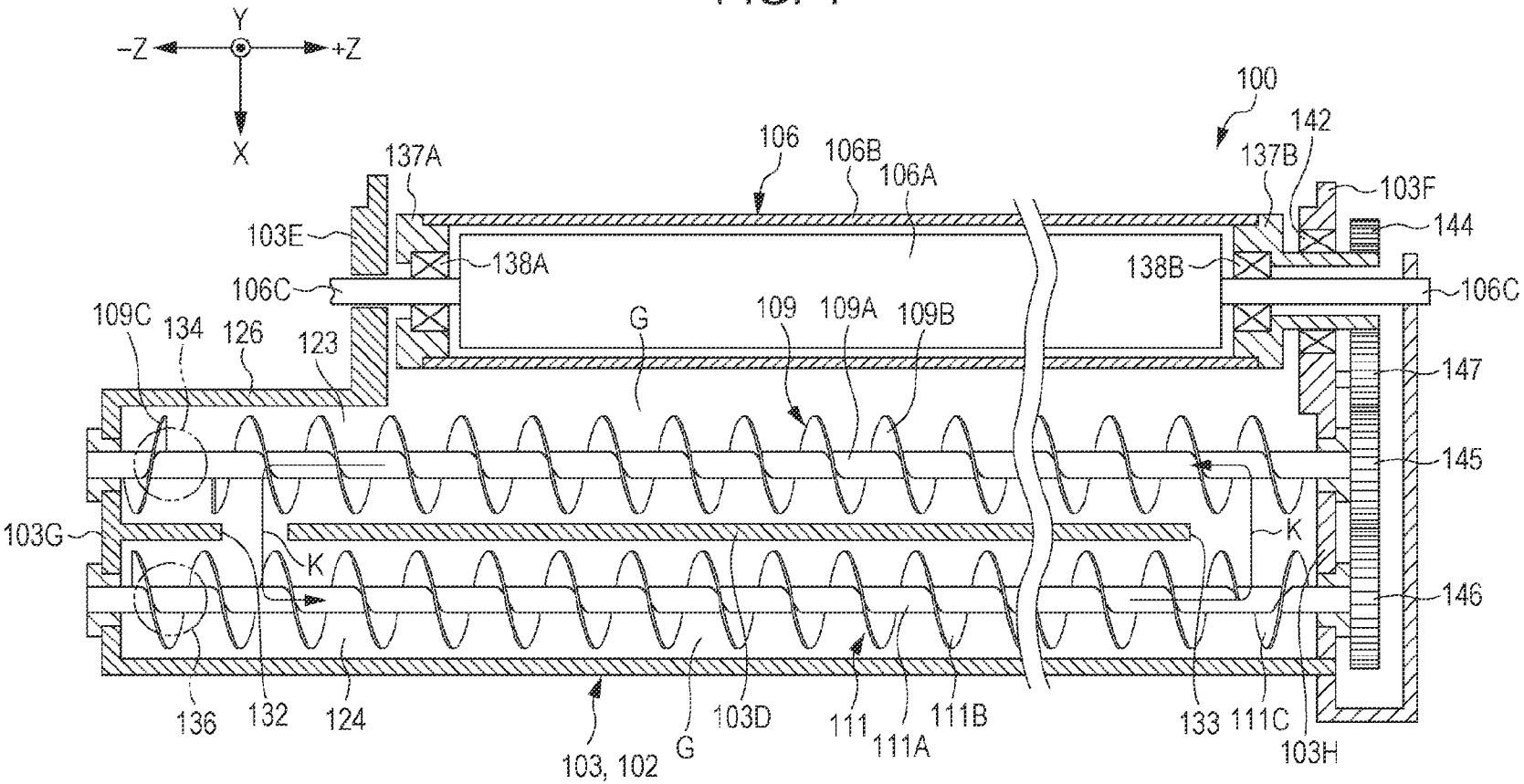
FIG. 4 is a longitudinal sectional view of the developing device according to the exemplary embodiment of the present invention.

FIG. 4 is a longitudinal sectional view of the developing device 100. In FIG. 4, the developing roller 106, the first auger 109, and the second auger 111 are shown as lying in the same plane for illustration purposes; in practice, as shown in FIG. 3A, the developing roller 106 is located above the first auger 109 and the second auger 111 in the Y direction. The rotating member 110 (see FIG. 3) is not shown in FIG. 4.

As illustrated in FIG. 4, the container body 103 includes support walls 103E and 103F disposed at both ends of the developing roller 106 in the axial direction (+Z direction). The support walls 103E and 103F support a shaft 106C protruding from both ends of a magnetic roller 106A, described later, outward in the +Z and −Z directions. The container body 103 also includes a protruding portion 126 that makes the first stirring chamber 123 and the second stirring chamber 124 longer than the distance between the support walls 103E and 103F in the −Z direction. The support walls 103E and 103F are joined together by a wall portion (not shown) extending under the developing roller 106. The trimmer 108 (see FIG. 3) is secured to the wall portion with screws (not shown).

The partition wall 103D has a first inflow port 132 and a second inflow port 133. The first inflow port 132 extends through the partition wall 103D in the X direction near the end thereof in the −Z direction. The second inflow port 133 extends through the partition wall 103D in the X direction near the end thereof in the +Z direction. As the first auger 109 and the second auger 111 rotate, the developer G is circulated through the first inflow port 132 and the second inflow port 133 in the direction indicated by the arrows K.

The protruding portion 126 has a developer discharge port 134 formed in the bottom of the first stirring chamber 123. The developer G is discharged from the developing device 100 through the developer discharge port 134. The protruding portion 126 also has a developer supply port 136 formed in the top of the second stirring chamber 124. The developing device 100 is supplied with fresh developer G through the developer supply port 136. The developer supply port 136 is located farther in the −Z direction than the first inflow port 132 and is separated from the developer discharge port 134 by the partition wall 103D. This prevents fresh developer G from being discharged through the developer discharge port 134 immediately after being supplied.

As illustrated in FIGS. 3A and 4, the developing roller 106 includes the magnetic roller 106A, which is an example of a magnetic source, and a developing sleeve 106B, which is an example of a developer-carrying member. The magnetic roller 106A has a solid cylindrical or substantially cylindrical shape and is attached to and supported by the container body 103 with the shaft 106C therebetween. The developing sleeve 106B has a hollow cylindrical or substantially cylindrical shape and is rotatably supported outside the magnetic roller 106A. That is, the developing sleeve 106B accommodates the magnetic roller 106A.

As illustrated in FIG. 3A, the magnetic roller 106A includes magnetic poles arranged along the outer surface thereof (in the circumferential direction). Specifically, as viewed in the axial direction of the shaft 106C, the magnetic roller 106A includes, in order from the lower right (near the first auger 109) in the clockwise direction, a pick-up pole S3, which is an example of an attractive pole, a layer-forming pole N2, a developing pole S1, a transport pole N1, and a pick-off pole S2. Although not shown, magnetic field lines extend from the transport pole N1 to the developing pole Si and the pick-off pole S2 and from the layer forming pole N2 to the developing pole Si and the pick-up pole S3.

The positions of the magnetic poles are described herein by referring to the top and bottom positions of the magnetic roller 106A as viewed in the axial direction as "12 o'clock position" and "6 o'clock position," respectively. For example, the pick-up pole S3 is disposed at the 4 o'clock position to cause the developer G to be attracted to the outer surface of the developing sleeve 106B. The layer-forming pole N2 is disposed at the 7 o'clock position, which is opposite the leading end of the trimmer 108, to form a brush of the magnetic carrier CA on the outer surface of the developing sleeve 106B. In this exemplary embodiment, the magnetic force of the pick-up pole S3 is smaller (set to a lower level) than usual (e.g., 80 mT). This reduces the drive torque of the developing roller 106 in the developing device 100.

The developing pole S1 is disposed at the 9 o'clock position, which is opposite the outer surface of the photoreceptor 62 (see FIG. 2). The transport pole N1 is disposed at the 11 o'clock position. After the development on the photoreceptor 62 (see FIG. 2) is complete, the transport pole N1 causes residual developer G to be attracted to the outer surface of the developing sleeve 106B. The pick-off pole S2 is disposed at the 2 o'clock position to remove the developer G from the developing sleeve 106B between the pick-off pole S2 and the pick-up pole S3.

As illustrated in FIG. 4, the developing sleeve 106B has a cap-shaped support member 137A (on the −Z direction side) and a cap-shaped support member 137B (on the +Z direction side) attached to both ends thereof in the Z direction to block the ends. The support members 137A and 137B are ring-shaped and have bearings 138A and 138B, respectively, fixed inside them, with the axis thereof oriented in the Z direction. The shaft 106C is inserted through the bearings 138A and 138B so that the developing sleeve 106B is rotatable relative to the magnetic roller 106A in the circumferential direction. The developing sleeve 106B has fine asperities on the outer surface thereof to carry the developer G thereon.

The support wall 103F has a bearing 142 fixed thereto, with the axis thereof oriented in the Z direction. A portion of the support member 137B is inserted into the bearing 142. A gear 144 is attached to the end of the support member 137B in the +Z direction so as to be rotatable, with the axis thereof oriented in the Z direction. As the gear 144 rotates, the support members 137A and 137B rotate about the shaft 106C, and accordingly the developing sleeve 106B rotates outside the magnetic roller 106A (e.g., rotates at a rotational speed of 413 rpm).

The first auger 109 is disposed in the first stirring chamber 123 to transport the developer G while stirring it. The first auger 109 includes a rotating shaft 109A oriented in the Z direction, a forward transport vane 109B, which is an example of a spiral vane portion, supported around the rotating shaft 109A, and a reverse transport vane 109C. The forward transport vane 109B extends from the second inflow port 133 to the first inflow port 132 to transport the developer G in the −Z direction.

The reverse transport vane 109C is disposed near the developer discharge port 134. The reverse transport vane 109C transports the developer G in the direction opposite to the transport direction of the forward transport vane 109B so that the developer G flows from the first stirring chamber 123 into the second stirring chamber 124. The rotating shaft 109A is rotatably supported by a front wall 103G at the end of the protruding portion 126 in the −Z direction and a rear wall 103H at the end of the container body 103 in the +Z direction. A gear 145 is attached to the end of the rotating shaft 109A in the +Z direction.

Thus, the first auger 109 is disposed opposite the developing sleeve 106B upstream of the trimmer 108 (see FIG. 3A) in the rotational direction of the developing sleeve 106B. The rotation axis direction of the first auger 109 is parallel to the rotation axis direction of the developing sleeve 106B (Z direction). As the forward transport vane 109B is rotated (e.g., rotated at a rotational speed of 367 rpm), the developer G is transported in the rotation axis direction and is supplied to the developing sleeve 106B.

The second auger 111 is disposed in the second stirring chamber 124 to transport the developer G while stirring it. The second auger 111 includes a rotating shaft 111A oriented in the Z direction, a forward transport vane 111B supported around the rotating shaft 111A, and a reverse transport vane 111C. The forward transport vane 111B extends from the first inflow port 132 to the second inflow port 133 to transport the developer G in the +Z direction.

The reverse transport vane 111C is disposed near the second inflow port 133. The reverse transport vane 111C transports the developer G in the direction opposite to the transport direction of the forward transport vane 111B so that the developer G flows from the second stirring chamber 124 into the first stirring chamber 123. The rotating shaft 111A is rotatably supported by the front wall 103G and the rear wall 103H. A gear 146 is attached to the end of the rotating shaft 111A in the +Z direction.

The gear 144 of the developing roller 106 meshes with the gear 145 of the first auger 109 with an intermediate gear 147 therebetween. The gear 145, in turn, meshes with the gear 146 of the second auger 111. The gear 144 is arranged to receive the rotational force of a motor (not shown) that functions as a driving source.

As the gear 144 is rotated by driving the motor (not shown), the gear 145 is rotated in the same direction as the gear 144, namely, in the +R direction (clockwise in FIG. 3A), whereas the gear 146 is rotated in the opposite direction to the gear 144, namely, in the −R direction (counterclockwise in FIG. 3A). That is, the first auger 109 and the second auger 111 rotate in opposite directions. As the first auger 109 and the second auger 111 rotate, the developer G in the first stirring chamber 123 and the developer G in the second stirring chamber 124 are transported and circulated in opposite directions. The developer G transported by the first auger 109 is supplied to the developing roller 106.

As illustrated in FIG. 3A, the developer G in the first stirring chamber 123 is carried on the developing sleeve 106B under the action of the pick-up pole S3 and is transported as the developing sleeve 106B rotates in the +R direction. The developer G carried on the developing sleeve 106B is advanced between the outer surface of the developing sleeve 106B and the leading end of the trimmer 108 to control the thickness of the layer of the developer G. The developer G is then transported to a developing region opposite the photoreceptor 62 (see FIG. 2).

The trimmer 108 is a plate-shaped member elongated in the Z direction. The trimmer 108 is disposed opposite the outer surface of the developing roller 106, with the lateral direction thereof oriented in a direction slightly inclined from the Y direction toward the X direction and the leading end (upper end surface 108A) thereof facing the shaft 106C. That is, the trimmer 108 is disposed below the developing sleeve 106B in the Y direction and is disposed opposite the layer-forming pole N2 with the developing sleeve 106B therebetween. The trimmer 108 controls the thickness of the layer of the developer G carried on the outer surface of the developing sleeve 106B.

The rotating member 110 will now be described.

Figure 5:
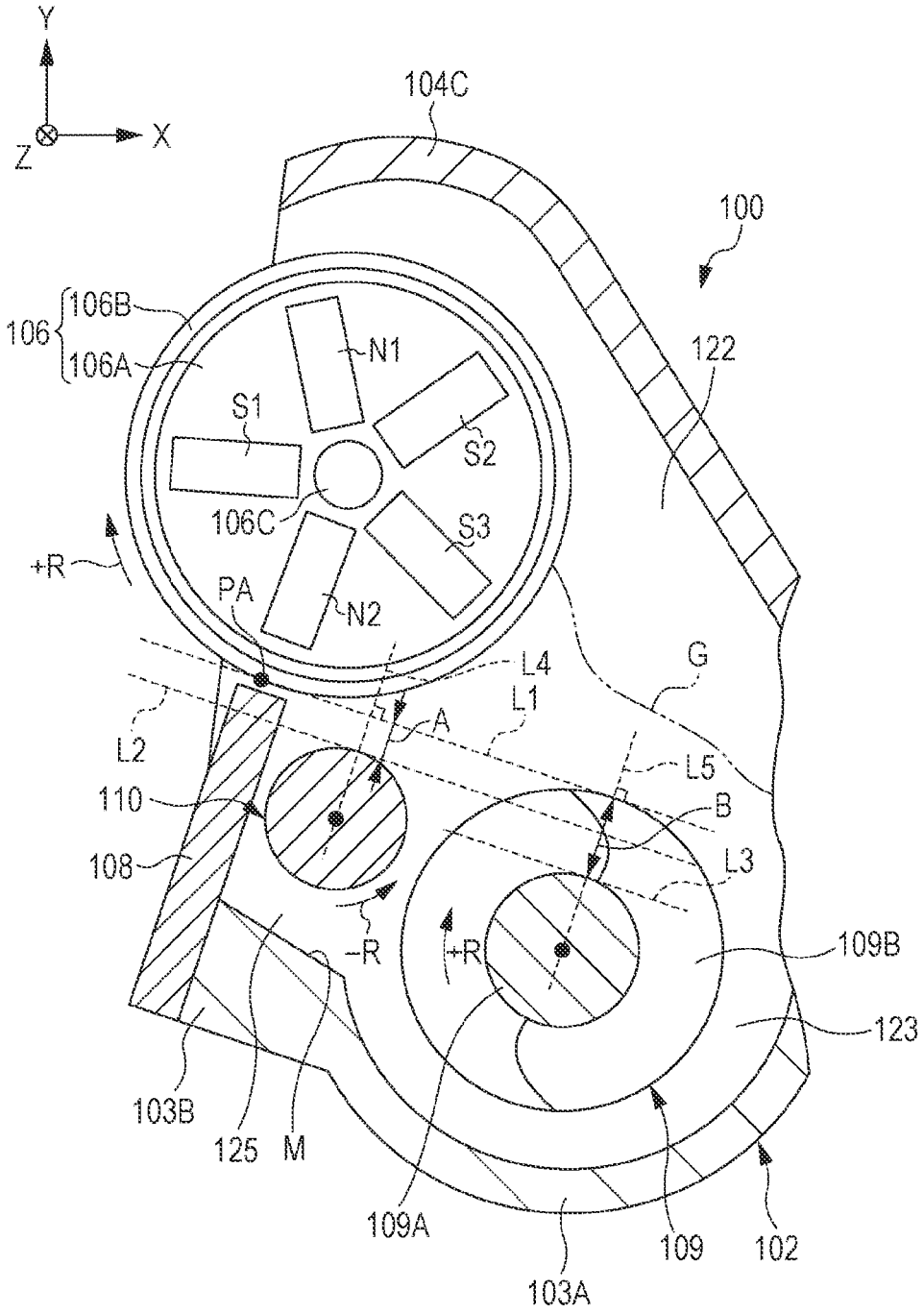
FIG. 5 is a schematic view illustrating the position of the rotating member according to the exemplary embodiment of the present invention.

As illustrated in FIG. 5, the developer return chamber 125 is surrounded by the developing roller 106, the trimmer 108, the extending portion 103B, and the first auger 109. The rotating member 110, which returns the developer G to the first auger 109, is disposed in the developer return chamber 125 at a distance from the developing roller 106, the trimmer 108, the extending portion 103B, and the first auger 109. The rotating member 110 is disposed opposite the developing sleeve 106B between the trimmer 108 and the first auger 109 and is rotated in the −R direction (counterclockwise in FIG. 5) by a drive unit 120, described later (e.g., rotated at a rotational speed of 413 rpm). The rotating member 110 and the developing return chamber 125 form a return unit that feeds (returns) the developer G to the first auger 109.

As illustrated in FIG. 3B, the rotating member 110 is, for example, a cylindrical or substantially cylindrical aluminum roller having the axis thereof oriented in the Z direction. As viewed in the Z direction, the rotating member 110 includes a body 110A having a diameter D1 and a cylindrical support shaft 110B protruding outward in the Z direction from both ends of the body 110A in the Z direction and having a diameter D2 (<D1). For example, the outer surface of the body 110A excluding both ends thereof in the Z direction is polished by sand blasting using regular or irregular particles as abrasive particles to form asperities S in an irregular arrangement. The term "irregular arrangement" refers to an arrangement in which few or no asperities aligned circumferentially or axially are found on the outer surface of the rotating member 110 when it is visually inspected.

The support shaft 110B is rotatably supported by bearings (not shown) disposed on the sidewalls 103E and 103F (see FIG. 4) disposed upright at both ends of the container body 103 (see FIG. 3A) in the Z direction. The drive unit 120 is provided at one end of the support shaft 110B. The drive unit 120 includes a motor and gear (not shown) and rotates the rotating member 110. In FIG. 3B, the line joining the drive unit 120 to the support shaft 110B indicates that driving force (rotational force) is transmitted from the drive unit 120 to the support shaft 110B.

As illustrated in FIG. 5, as the developing device 100 is viewed in the Z direction, the layer control position on the outer surface of the developing sleeve 106B opposite the trimmer 108 is referred to as a point PA, and the tangent at the point PA is referred to as a tangent L1. A tangent, parallel to the tangent L1, to the outer surface of the rotating member 110 (on the side facing the developing sleeve 106B) is referred to as a tangent L2. A tangent, parallel to the tangent L1, to the outer surface of the rotating shaft 109A of the first auger 109 (on the side facing the developing sleeve 106B) is referred to as a tangent L3.

The rotating member 110 and the first auger 109 are disposed so as to satisfy A/B≤½ or about ½, where A is the shortest distance between the tangents L1 and L2, and B is the shortest distance between the tangents L1 and L3. The shortest distance A is the distance along a perpendicular line L4 drawn from the tangent L1 to the outer surface of the rotating member 110. The shortest distance B is the distance along a perpendicular line L5 drawn from the tangent L1 to the outer surface of the rotating shaft 109A of the first auger 109.

COMPARATIVE EXAMPLE

A comparative example including no rotating member 110 will now be described.

Figure 8A:
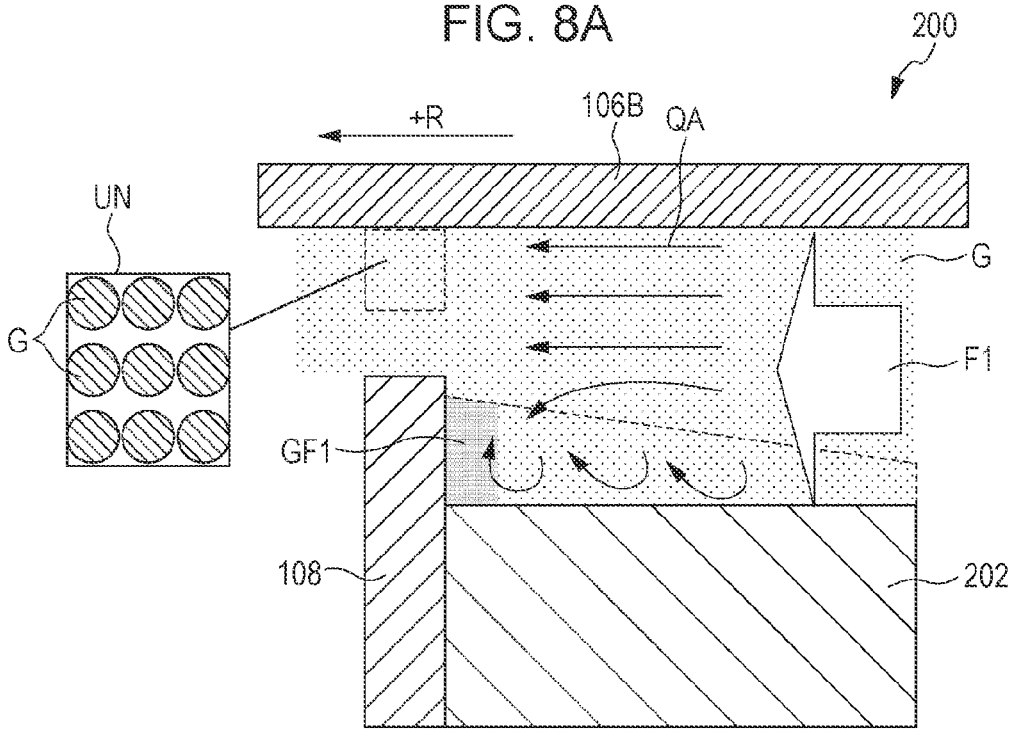
FIGS. 8A and 8B are schematic views illustrating how a buildup of developer forms an immobile layer in a comparative example.

FIG. 8A schematically illustrates the trimmer 108 and the surroundings thereof in a developing device 200 of the comparative example. The developing device 200 of the comparative example is similar to the developing device 100 (see FIG. 5) of the exemplary embodiment except that the rotating member 110 (see FIG. 5) is replaced by a rectangular block 202. The block 202 is disposed at a distance from the outer surface of the developing sleeve 106B and in contact with the side surface of the trimmer 108.

FIG. 8A shows the initial state of the developing device 200 of the comparative example before repeated development. As the developing sleeve 106B rotates in the +R direction, the developer G is transported to the trimmer 108 (indicated by the arrows QA). The developer G is then advanced between the developing sleeve 106B and the leading end of the trimmer 108 to control the layer of the developer G. The density of the developer G in a unit volume UN (indicated by the rectangular frame UN) after the layer control is sufficiently high relative to the amount of developer G transported necessary for development on the photoreceptor 62 (see FIG. 2).

The developing device 200 of the comparative example, however, has little space into which the developer G flows (escapes) in a region between the developing sleeve 106B and the block 202 and near the trimmer 108. In addition, the developer G present in the region near the trimmer 108 has no force sufficient to move against a transport force F1 that transports the developer G toward the clearance between the developing sleeve 106B and the trimmer 108. As a result, a buildup (aggregates) of the developer G forms an immobile layer GF1 in the region near the trimmer 108.

Figure 8B:
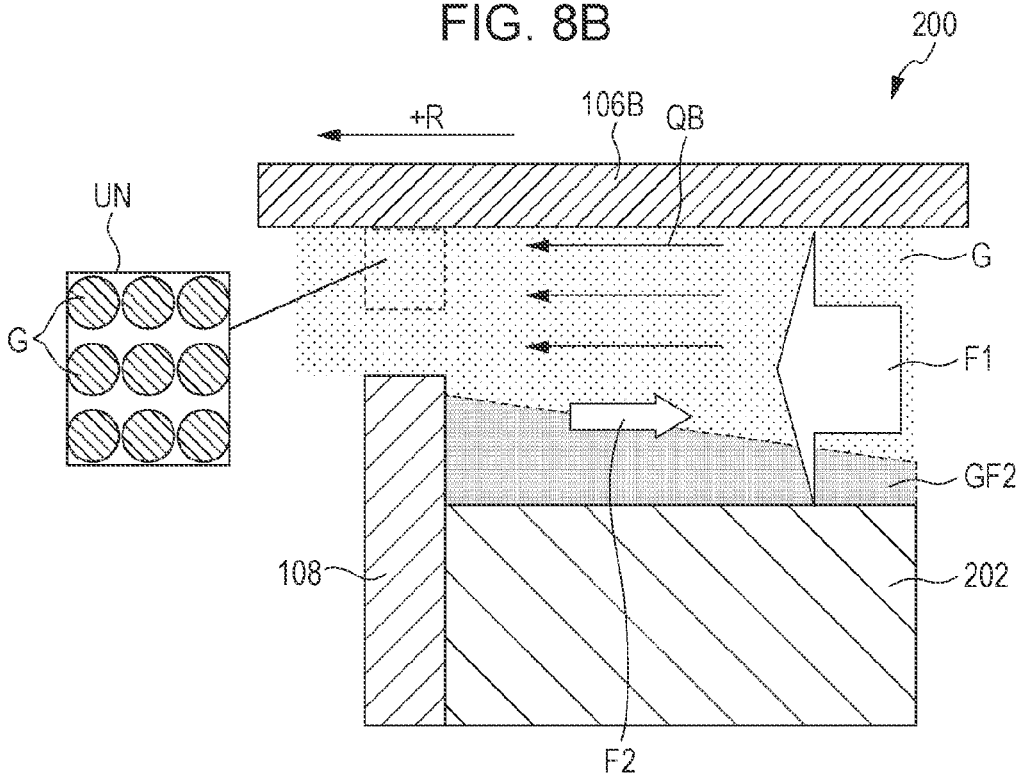

FIG. 8B shows the state of the developing device 200 of the comparative example after repeated development. In this state, a larger (accumulated) immobile layer GF2 forms than in the initial state. This immobile layer GF2 exerts a reaction force F2 on the developer G transported toward the clearance between the developing sleeve 106B and the trimmer 108 in the opposite direction to the transport force F1 (indicated by the arrows QB). As a result, a portion of the developer G that cannot resist the reaction F2 remains, and the pressure exerted on the developer G between the developing sleeve 106B and the trimmer 108 drops (i.e., a pressure loss occurs). This results in a lower density of the developer G in the unit volume UN after the layer control than in the initial state. Thus, the amount of developer G on the developing sleeve 106B after the layer control (the amount of developer G transported) becomes smaller after repeated development (over time) than in the initial state.

Operation

The operation of this exemplary embodiment will now be described.

Figure 6:
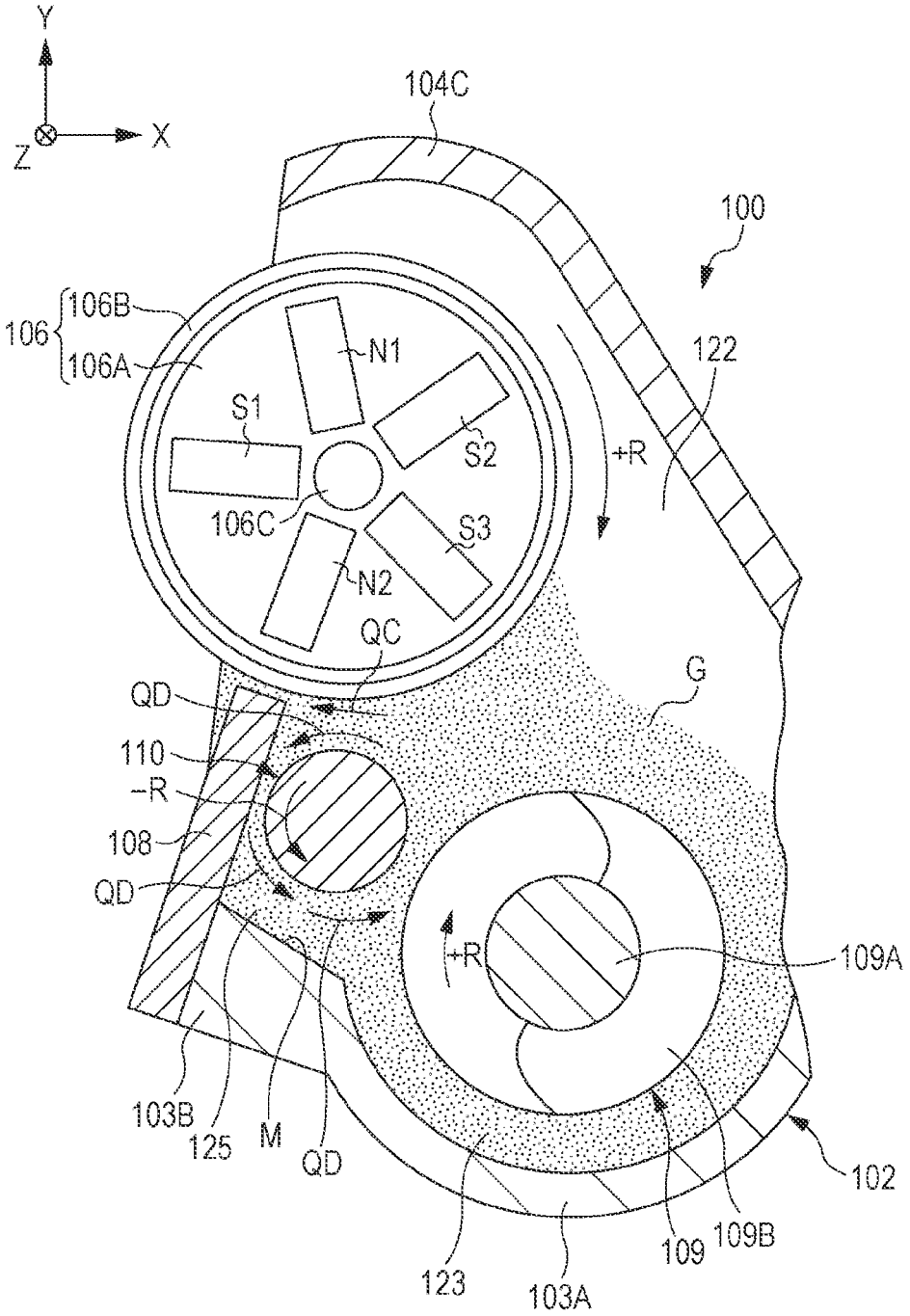
FIG. 6 is a schematic view illustrating a flow of developer caused by the rotating member according to the exemplary embodiment of the present invention.

As illustrated in FIG. 6, as the first auger 109 (and the second auger 111 (see FIG. 3A)) rotates in the developing device 100, the developer G contained in the housing 102 is transported while being stirred. The developer G transported to the first stirring chamber 123 is supplied to the developing sleeve 106B and is carried on the outer surface of the developing sleeve 106B by the magnetic force of the pick-up pole S3. The trimmer 108 controls the thickness of the layer of the developer G on the outer surface of the developing sleeve 106B.

When the drive unit 120 (see FIG. 3B) of the developing device 100 starts operating, the rotating member 110 rotates in the developer return chamber 125. This rotation causes a flow QC of the developer G toward the clearance between the developing sleeve 106B and the trimmer 108 and a flow QD of the developer G toward the first auger 109 along the outer surface of the rotating member 110 between the developing sleeve 106B and the rotating member 110.

Figure 7:
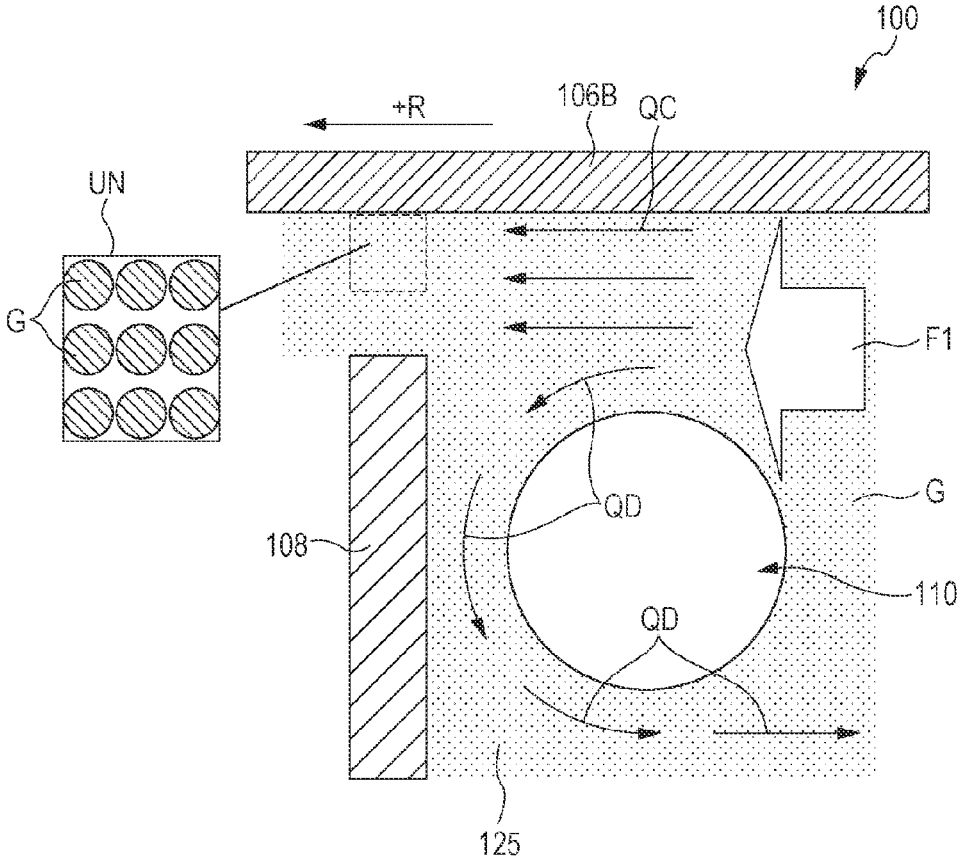
FIG. 7 is a schematic view illustrating how the rotating member according to the exemplary embodiment of the present invention allows less buildup of developer to form.

FIG. 7 shows the initial state of the developing device 100 before repeated development. As the developing sleeve 106B rotates in the +R direction, the developer G is transported to the trimmer 108 (indicated by the arrows QC). The developer G is then advanced between the developing sleeve 106B and the leading end of the trimmer 108 to control the layer of the developer G. The density of the developer G in a unit volume UN (indicated by the rectangular frame UN) after the layer control may be sufficiently high relative to the amount of developer G transported necessary for development on the photoreceptor 62 (see FIG. 2).

The developing device 100 has a space into which the developer G flows (escapes) in a region between the developing sleeve 106B and the rotating member 110 and near the trimmer 108. As the rotating member 110 rotates, the developer G flows to the first auger 109. This may allow little buildup (aggregates) of the developer G to form in the region near the trimmer 108 and may thus allow little immobile layer to form.

Because the developing device 100 may allow little immobile layer to form over time, the space through which the developer G is transported may be maintained. This may maintain the amount of developer G transported to the clearance between the developing sleeve 106B and the trimmer 108. In addition, because the developing device 100 may allow little immobile layer to form, little reaction force may be exerted in the direction opposite to the transport direction. This may maintain the pressure exerted on the developer G (i.e., reduce the pressure loss). Thus, the amount of developer G on the developing sleeve 106B after the trimmer 108 controls the thickness of the layer of the developer G may be maintained over time.

Because the rotating member 110 of the developing device 100 has irregular asperities formed on the outer surface, it has a larger surface area for carrying the developer G than without such asperities. This may result in a larger amount of developer G transported by the developing sleeve 106B with a smaller magnetic force of the attractive pole S3 (see FIG. 5) than usual.

Because the rotating member 110 of the developing device 100 has a cylindrical or substantially cylindrical shape having the axis thereof oriented in the Z direction, i.e., the cross-section thereof is uniform along the axis thereof, the distance (space) between the developing sleeve 106B and the rotating member 110 may have little variation in the axial direction when the rotating member 110 rotates. This may result in little variation in the amount of developer G on the developing sleeve 106B in the axial direction. In addition, because the rotating member 110 has a cylindrical or substantially cylindrical shape, i.e., the surface profile thereof is uniform along the axis thereof, the distance (space) between the developing sleeve 106B and the rotating member 110 may have little variation in the circumferential direction when the rotating member 110 rotates. This may result in little variation in the amount of developer G on the developing sleeve 106B in the circumferential direction.

Because the rotating member 110 of the developing device 100 is forcedly rotated by the drive unit 120 (see FIG. 3B), it may be more reliably adjusted to the necessary rotational speed than a rotating member that is rotated as another member rotates. This may enhance the flow (pressure) of the developer G caused by the rotating member 110, thus increasing the amount of developer G flowing (returning) to the first auger 109.

In the developing device 100, the distance between the tangent L1 to the outer surface of the developing sleeve 106B and the rotating member 110 is shorter than the distance between the tangent L1 to the outer surface of the developing sleeve 106B and the first auger 109. That is, the space between the developing sleeve 106B and the rotating member 110 is narrower than the space between the developing sleeve 106B and the first auger 109. As a result, pressure may be applied to the developer G before it is advanced between the developing sleeve 106B and the trimmer 108. This may allow a uniform pressure to be applied to the developer G advanced between the developing sleeve 106B and the rotating member 110 in the axial direction, even if the spiral forward transport vane 109B of the first auger 109 causes variation in the amount of developer G transported by the developing sleeve 106B (pressure variation) in the axial direction because of a smaller magnetic force of the attractive pole S3 (see FIG. 5) than usual. Thus, little variation may occur in the amount of developer G transported by the developing sleeve 106B in the axial direction.

FIG. 9 shows results of the variation in the amount of developer G transported by the developing sleeve 106B in the axial direction (Z direction) and the change in the amount of developer G transported by the developing sleeve 106B over time (as an example, after development is repeated a number of times equivalent to image formation on 2,000 sheets of recording paper P). The parameter is A/B, where A is the shortest distance between the tangents L1 and L2 of the developing device 100 illustrated in FIG. 5, and B is the shortest distance between the tangents L1 and L3. A/B is varied in the range of 0.25 to 0.80 by changing the shortest distance A without changing the shortest distance B.

The variation in the amount of developer G transported by the developing sleeve 106B in the axial direction is evaluated as "A," "B," or "C" by visually inspecting the toner images fixed to the recording paper P. "A" indicates that there is little variation. "B" indicates that there are slight local variations, but they are negligible as a whole. "C" indicates that there are noticeable variations.

The change in the amount of developer G transported by the developing sleeve 106B over time is evaluated as "A," "B," or "C" by forming images both in the initial state and after repeated development and visually inspecting the toner images fixed to the recording paper P. "A" indicates that there is little difference between the densities in the initial state and after repeated development. "B" indicates that there is a slight local difference between the densities in the initial state and after repeated development, but it is negligible as a whole. "C" indicates that there is a noticeable difference between the densities in the initial state and after repeated development.

The results shown in FIG. 9 demonstrate that little change occurs in the amount of developer G transported over time with varying A/B in the range of 0.20 to 0.80. The results also demonstrate that little variation occurs in the amount of developer G transported by the developing sleeve 106B in the axial direction if A/B is 0.25 (i.e., ¼) to 0.5 (i.e., ½) or about 0.25 (i.e., about ¼) to about 0.5 (i.e., about ½). The results also demonstrate that the amount of developer G transported is insufficient if A/B is 0.2 or less.

With the rotating member 110, the image-forming apparatus 10 may maintain the amount of developer G transported to the photoreceptor 62 (photoreceptors 62K, 62Y, 62M, and 62C) over time. This may maintain the image density after development in large quantities because the amount of developer G remains comparable to that in the initial state.

The present invention is not limited to the exemplary embodiment discussed above.

The rotating member 110 may have any other shape that causes little variation in the amount of developer G transported by the developing sleeve 106B in the axial direction and little change in the amount of developer G transported over time. For example, the rotating member 110 may be polygonal or oval in a cross-section crossing the axial direction. Alternatively, the rotating member 110 may be plate-shaped.

The rotating member 110 may have grooves (e.g., grooves having a U-shaped or V-shaped cross-section), extending in the circumferential direction or axial direction (longitudinal direction), that cause little variation in the amount of developer G transported by the developing sleeve 106B in the axial direction and little change in the amount of developer G transported over time.

The rotating member 110 may be replaced by multiple rotating members having a smaller diameter than the rotating member 110.

The top surface M of the extending portion 103B may be curved so that the developer G flows easily to the first auger 109.

In an exemplary embodiment in which the developer G is stored above the developing sleeve 106B, the trimmer 108 and the rotating member 110 may be disposed above the center of rotation of the developing sleeve 106B.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A developing device comprising:

a developer-carrying member that is substantially tubular, that accommodates a magnetic source that generates a magnetic force for carrying a developer containing magnetic particles on an outer surface thereof, and that rotates in a circumferential direction thereof;

a developer control member that is disposed opposite the developer-carrying member and that controls the thickness of a layer of the developer carried on the outer surface of the developer-carrying member;

a supply member that is disposed opposite the developer-carrying member upstream of the developer control member in a rotational direction of the developer-carrying member and that rotates to transport the developer in a rotation axis direction thereof and to supply the developer to the developer-carrying member; and a rotating member that is rotatably disposed opposite the developer-carrying member at a position where the rotating member is submerged in the developer between the developer control member and the supply member and that rotates to supply the developer from between the developer control member and the supply member to the supply member, wherein:

the supply member includes a rotating shaft and a vane portion disposed therearound;

the developer control member is disposed below the developer-carrying member in a vertical direction; and about $\frac{1}{4} \leq A/B \leq$ about $\frac{1}{2}$ is satisfied, where A is a shortest distance between a tangent to the outer surface of the developer-carrying member at a layer control position opposite the developer control member and an outer surface of the rotating member, and B is a shortest distance between the tangent to the outer surface of the developer-carrying member at the layer control position opposite the developer control member and an outer surface of the rotating shaft of the supply member.

2. The developing device according to claim 1, wherein the rotating member has asperities in an irregular arrangement on an outer surface thereof.

3. The developing device according to claim 2, wherein the rotating member is substantially cylindrical.

4. The developing device according to claim 2, further comprising a drive unit that drives the rotating member.

5. The developing device according to claim 3, further comprising a drive unit that drives the rotating member.

6. The developing device according to claim 1, wherein the rotating member is substantially cylindrical.

7. The developing device according to claim 6, further comprising a drive unit that drives the rotating member.

8. The developing device according to claim 1, further comprising a drive unit that drives the rotating member.

9. An image-forming apparatus comprising:

an image-carrying member that carries a latent image on an outer surface thereof;

the developing device according to claim 1, the developing device developing the latent image with a developer to form a developer image; and a transfer unit that transfers the developer image from the image-carrying member to a recording medium.

10. A developing device comprising:

a developer-carrying member that is substantially tubular, that accommodates a magnetic source that generates a magnetic force for carrying a developer containing magnetic particles on an outer surface thereof, and that rotates in a circumferential direction thereof;

a developer control member that is disposed opposite the developer-carrying member and that control the thickness of a layer of the developer carried on the outer surface of the developer-carrying member;

a supply member that is disposed opposite the developer-carrying member upstream of the developer control member in a rotational direction of the developer-carrying member and that rotates to transport the developer in a rotation axis direction thereof and to supply the developer to the developer-carrying member; and a rotating member that is rotatably disposed opposite the developer-carrying member at a position where the rotating member is submerged in the developer between the developer control member and the supply member and that rotates to supply the developer from between the developer control member and the supply member to the supply member, wherein the rotating member has asperities in an irregular arrangement on an outer surface thereof.

11. The developing device according to claim 10, wherein the rotating member is substantially cylindrical.

12. The developing device according to claim 11, further comprising a drive unit that drives the rotating member.

13. The developing device according to claim 10, further comprising a drive unit that drives the rotating member.

* * * * *